US006336442B1

(12) United States Patent
Kilgore

(10) Patent No.: US 6,336,442 B1
(45) Date of Patent: Jan. 8, 2002

(54) ASSEMBLY FOR ATTACHMENT OF A HOUSING TO A STRUCTURAL MEMBER

(75) Inventor: Jason T. Kilgore, Newport News, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/565,026

(22) Filed: May 5, 2000

(51) Int. Cl.[7] ..... F02M 37/04
(52) U.S. Cl. ..... 123/456; 123/457
(58) Field of Search ..... 123/456, 457, 123/458, 463, 468

(56) References Cited

U.S. PATENT DOCUMENTS 5,088,463 A * 2/1992 Affeldt et al. ..... 123/459
5,094,211 A * 3/1992 Mahnke et al. ..... 123/463
5,105,787 A * 4/1992 Imoehl ..... 123/469
5,146,896 A * 9/1992 Imoehl et al. ..... 123/456
5,533,478 A * 7/1996 Robinson ..... 123/456
5,577,478 A * 11/1996 Tuckey ..... 123/456

* cited by examiner

*Primary Examiner*—Thomas N. Moulis

(57) ABSTRACT

An assembly having a support structure and a body attached to the support structure by a retention member. The support structure having a pocket proximate a surface. The pocket having a wall, which defines a chamber, with a first end connected to the surface and a second end projecting away from the surface. A lip disposed proximate the second end of the wall, and a port projects from the surface into the chamber. The body at least partially disposed within the chamber of the pocket, and a retention device attaching the body to the wall of the pocket by engaging both the body and the lip.

20 Claims, 2 Drawing Sheets

ASSEMBLY FOR ATTACHMENT OF A HOUSING TO A STRUCTURAL MEMBER

FIELD OF INVENTION

This invention relates to an attachment assembly that can be used as a general purpose attachment mechanism to retain a housing to a structural member.

BACKGROUND OF INVENTION

There are many types of attachment devices to retain a member to a base. These attachment devices include clips, fasteners, flanges, and the like. Some of these attachment devices are limited in use to specific items, while others may be used with a variety of equipment.

SUMMARY OF THE INVENTION

The present invention provides an assembly having a support structure and a body attached to the support structure by a retention member. The support structure has a pocket proximate a surface. The pocket has a wall, which defines a chamber, with a first end connected to the surface and a second end projecting away from the surface. A lip is disposed proximate the second end of the wall, and a port projects from the surface into the chamber. The body is at least partially disposed within the chamber of the pocket, and a retention device attaches the body to the wall of the pocket by engaging both the body and the lip.

The present invention also provides a medium supply device having a housing with a surface and a passage therein. A port projects away from the surface and communicates with the passage. A pocket is located proximate the surface and surrounds the port. The pocket has a wall, which defines a chamber, with a first end proximate the surface and a second end projecting away from the surface.

One embodiment of the body of the present invention includes a first member, a second member, which is axially displaced from the first member, that provides a medium receiving opening, and a diaphragm separating the first member and second member. The first member includes a first flange, and the second member includes a second flange. Preferably, a spring biases the diaphragm toward the first member, a first exterior of a spacer engages the diaphragm, and a second exterior of the spacer is exposed to the medium receiving opening.

One embodiment of the retention device of the present invention includes a support portion and a plurality of retention members. The support portion is disposed between the first flange and the second flange, and the plurality of retention members extends from the support portion toward the medium receiving opening and engages the lip of the wall.

The present invention also provides a method of securing an assembly to a medium supply device. This method includes: providing a housing having a surface; disposing a pocket, which has a wall, that defines a chamber and has a first thickness, proximate the surface; and placing a body at least partially within the chamber of the pocket. In this method, the body has a wall with a second thickness less than the first thickness.

BRIEF DESCRIPTION OF THE DRAWINGS

The accompanying drawings, which are incorporated herein and constitute part of this specification, illustrate the presently preferred embodiment of the invention, and, together with the general description given above and the detailed description given below, serve to explain the features of the invention.

DETAILED DESCRIPTION OF THE PREFERRED EMBODIMENT

Figure 1:
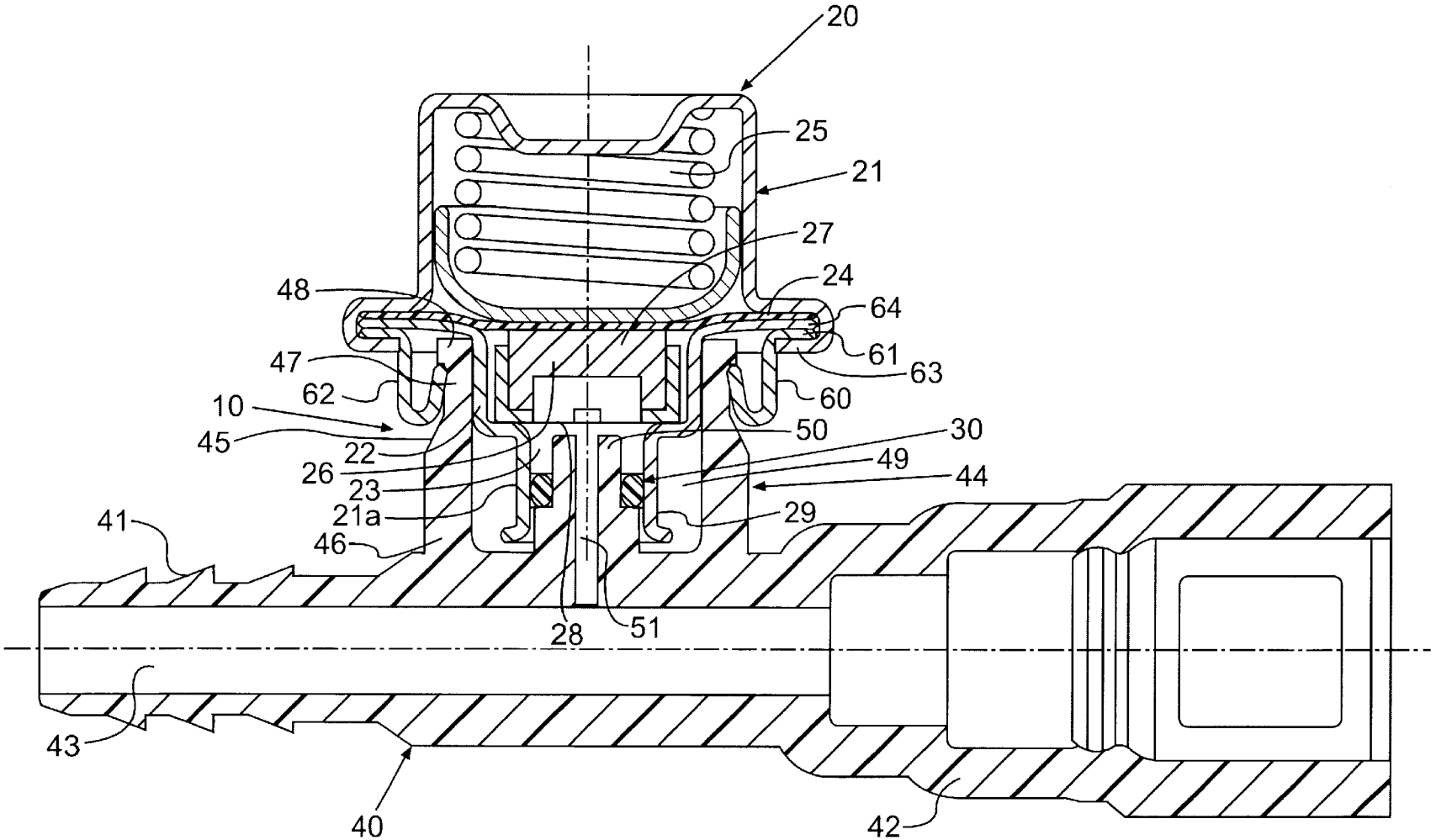
FIG. 1 is a cross-sectional view of a preferred embodiment of the assembly of the present invention.

FIG. 1 illustrates a preferred embodiment of the assembly 10 that attaches a body 20 to a support structure 40 with a retaining device 60. The support structure 40 has a surface 41. The support structure 40 may be made of plastic. In the preferred embodiment, the support structure also has a housing 42 with a passage, which is a fluid supply device and more particularly, a fuel rail. Alternatively, the passage 43 may be a fuel line, fuel pump module, jumper line, or any other device that transports a medium from one locality to another. A pocket 44 is disposed proximate the surface 41. The pocket 44 may be plastic and is, preferably, molded onto the surface 41 of the support structure 40. The pocket 44 has a wall 45 with a first end 46 connected to the surface 41 and a second end 47 projecting away from the surface 41. In the preferred embodiment, the pocket 44 is cylindrical in shape. A lip 48 is disposed proximate the second end 47 of the wall 45. A chamber 49 is formed within wall 45 into which a port 50 projects from the surface 41. In the preferred embodiment, the port 50 is cylindrical in shape and is centered within the wall 45. Preferably, the port 50 has a passage 51 that communicates with the passage 43 of the housing 42.

Figure 2:
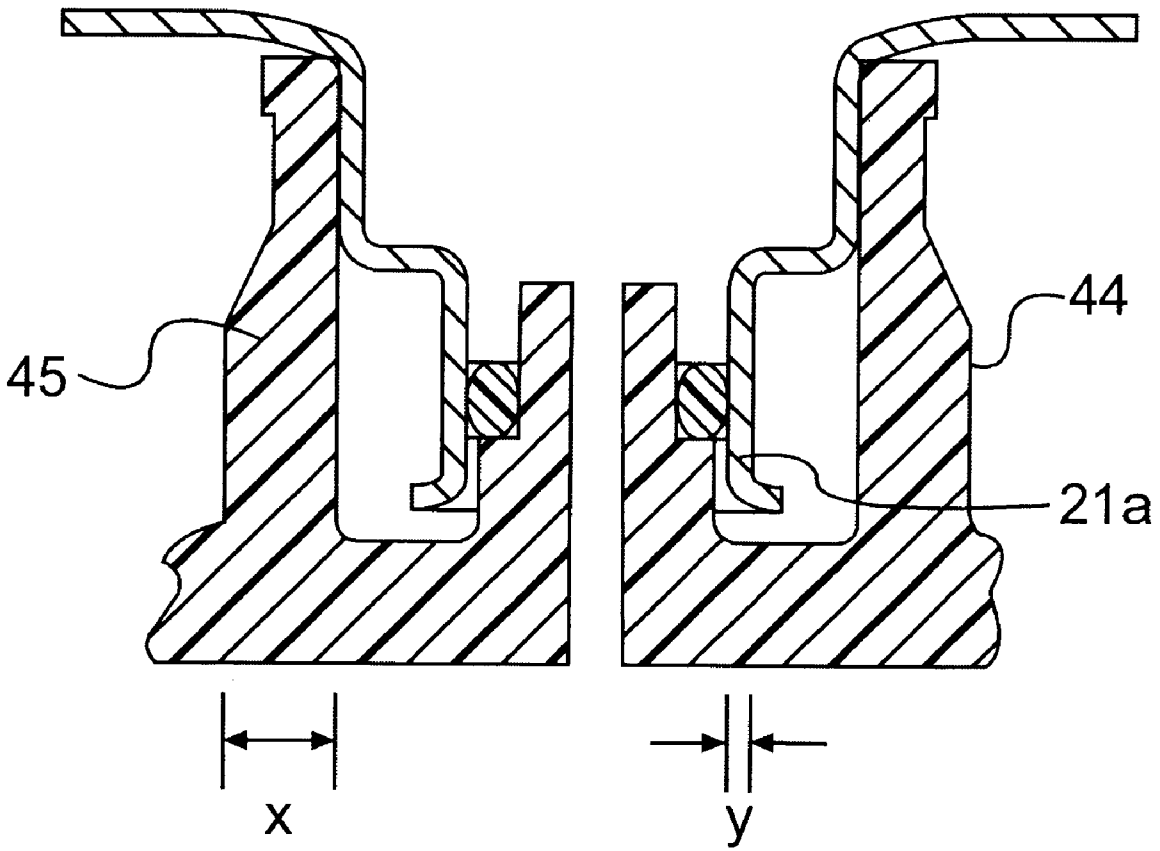
FIG. 2 is a cross sectional view of the pocket and the first member of the body of FIG. 1.

The body 20 is at least partially disposed within the chamber 49 and secured to the wall 45 of the pocket 44 by the retention device, or preferably, clip, 60, which engages both the body 20 and the lip 48. In the preferred embodiment, the body 20 has a first member 21 with a wall 21*a* and a second member 22, axially displaced from the first member 21, that provides a medium receiving opening 23 to the body 20. In the preferred embodiment, the wall 45 of the pocket 44 is thicker than the wall 21*a* of the first member 21, as shown in FIG. 2. Most preferably, the thickness X of the wall 45 of the pocket 44 is approximately three times the thickness Y of the wall 21*a* of the first member 21. The greater thickness of the wall 45 of the pocket 44 provides structural rigidity to the pocket 44. A, preferably flexible, diaphragm 24 separates the first member 21 and the second member 22. The diaphragm 24 is secured in place between the first member 21 and the second member 22. The first member 21 is, preferably, a cover that creates a sealed chamber with the diaphragm 24.

In the preferred embodiment, the body 20 includes a spring 25 biasing the diaphragm 24 toward the first member 21, and a spacer 26 with a first exterior 27 engaging the diaphragm 24 and a second exterior 28 exposed to the medium receiving opening 23. The spacer 26 is disposed in the second member 22, and is, preferably, a substantially cylindrical member. The medium flow allows the spacer 26 to float freely in the second member 22. The force of spring 25 limits axial movement of the spacer 26 toward the first member, or cover, 21. Further details of the spacer and spring are described in co-pending U.S. patent application Ser. No. 09/438,291, entitled "Pressure Pulsation Damper Containing a Free Floating Spacer," filed Nov. 12, 1999, which is incorporated herein by reference.

In the preferred embodiment, the body 20 is a damper that attenuates pressure pulsations. However, the body 20 may be a pressure regulator, fuel pump, or any other device that receives a medium. Preferably, a portion 29 of the body 20, or more specifically, the second member 22, surrounds the port 50, where the port 50 projects into the second member 22. In the preferred embodiment, the body 20 also has a seal 30 located between the port 50 and the portion 29 of the body 20. The seal 30 is, preferably, an O-ring seal.

In the preferred embodiment, the clip 60 is fixedly secured to the body 20 and is a sheet metal clip. Preferably, the clip 60 has a support portion 61 and a plurality of retention members 62. The support portion 61 of the clip 60 is disposed between a first flange 63 of the first member 21 and a second flange 64 of the second member 22. The retention members 62 extend away from the support portion 61 toward the medium receiving opening 23 and engage the lip 48 of the wall 45. Further details of this clip are disclosed in commonly-assigned, co-pending U.S. patent application Ser. No. 09/086,084, entitled "Fuel Rail Damper," filed May 28, 1998, which is hereby incorporated in its entirety by reference.

While the invention has been disclosed with reference to certain preferred embodiments, numerous modifications, alterations, and changes to the described embodiments are possible without departing from the sphere and scope of the invention, as defined in the appended claims and their equivalents thereof. Accordingly, it is intended that the invention not be limited to the described embodiments, but that it have the full scope defined by the language of the following claims.

What we claim is:

1. An assembly comprising:

a support structure having a pocket proximate a surface, the pocket having a wall having a first end connected to the surface and a second end projecting away from the surface, the wall defining a chamber, a lip disposed proximate the second end of the wall, and a port projecting from the surface into the chamber;

a body at least partially disposed within the chamber of the pocket; and a retention device that attaches the body to the wall of the pocket by engaging both the body and the lip.

2. The assembly of claim 1 wherein the support structure comprises a housing having a passage.

3. The assembly of claim 2 wherein the port comprises a passage that communicates with the passage of the housing.

4. The assembly of claim 3 wherein the body comprises a portion that surrounds the port.

5. The assembly of claim 4 further comprising a seal between the port and the body.

6. The assembly of claim 5 wherein the passage is a fluid supply device.

7. The assembly of claim 6 wherein the fluid supply device is a fuel rail.

8. The assembly of claim 1 wherein the retention device is fixedly secured to the body.

9. The assembly of claim 1 wherein the retention device comprises a sheet metal clip.

10. The assembly of claim 9 wherein the body comprises a first member, a second member axially, displaced from the first member, that provides a medium receiving opening, and a diaphragm separating the first member and second member, the first member including a first flange, the second member including a second flange.

11. The assembly of claim 10 wherein the clip comprises a support portion and a plurality of retention members, the support portion being disposed between the first flange and the second flange, and the plurality of retention members extending from the support portion toward the medium receiving opening and engaging the lip of the wall.

12. The assembly of claim 11 wherein the body further comprises a spring biasing the diaphragm toward the first member, and a spacer having a first exterior engaging the diaphragm and a second exterior exposed to the medium receiving opening.

13. The assembly of claim 12 wherein the port comprises a passage that communicates with a passage defined by the support structure.

14. The assembly of claim 13 wherein the port projects into the second member of the body.

15. A medium supply device comprising;

a housing having a surface;

a passage within the housing;

a port projecting away from the surface, the port communicating with the passage;

a pocket proximate the surface and surrounding the port, the pocket having a wall having a first end proximate the surface and a second end projecting away from the surface, the wall defining a chamber;

a lip disposed proximate the second end of the wall;

a body at least partially disposed within the chamber of the pocket;

a retention device that attaches the body to the wall of the pocket by engaging both the wall and the lip; and a seal between the port and the body.

16. The medium supply device of claim 15 wherein the port projects into the chamber of the pocket.

17. The medium supply device of claim 16 wherein the housing, port, and pocket comprise plastic.

18. A method of securing an assembly to a medium supply device, the method comprising:

providing a housing having a surface;

disposing a pocket proximate the surface, the pocket having a wall with a first thickness, the wall defining a chamber;

placing a body at least partially within the chamber of the pocket, the body having a wall with a second thickness less than the first thickness;

extending a port from the surface;

communicating the port with a passage in the housing;

providing a lip disposed proximate an end of the wall projecting away from the surface, disposing a seal between the port and the body; and securing the body to the pocket with a retention device.

19. The assembly of claim 18 wherein the placing comprises fixedly securing the retention device to the body.

20. The method of claim 18 wherein the placing comprises projecting the port into the chamber of the pocket and a portion of the body.

* * * * *